US010139747B2

(12) United States Patent
Yamada et al.

(10) Patent No.: US 10,139,747 B2
(45) Date of Patent: Nov. 27, 2018

(54) ELECTROPHOTOGRAPHIC ROLLER AND CHARGING APPARATUS

(71) Applicant: CANON KABUSHIKI KAISHA, Tokyo (JP)

(72) Inventors: Satoru Yamada, Numazu (JP); Toshiro Suzuki, Gotemba (JP); Yuya Tomomizu, Yokohama (JP); Toshimitsu Nakazawa, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/740,278

(22) PCT Filed: Jun. 23, 2016

(86) PCT No.: PCT/JP2016/003034

§ 371 (c)(1),
(2) Date: Dec. 27, 2017

(87) PCT Pub. No.: WO2017/002336

PCT Pub. Date: Jan. 5, 2017

(65) Prior Publication Data

US 2018/0188666 A1 Jul. 5, 2018

(30) Foreign Application Priority Data

Jun. 30, 2015 (JP) ..... 2015-132036

(51) Int. Cl.
*G03G 15/02* (2006.01)

(52) U.S. Cl.
CPC ... *G03G 15/0233* (2013.01); *G03G 2215/021* (2013.01)

(58) Field of Classification Search
CPC ..... G03G 15/0233
See application file for complete search history.

(56) References Cited

U.S. PATENT DOCUMENTS

| | | | | |
|---|---|---|---|---|
| 5,283,621 | A | 2/1994 | Hashizume | |
| 5,512,976 | A * | 4/1996 | Kamano | G03G 15/751 399/116 |
| 2006/0120759 | A1 | 6/2006 | Higaki | |
| 2014/0079434 | A1 | 3/2014 | Sakashita et al. | |

(Continued)

FOREIGN PATENT DOCUMENTS

| | | | |
|---|---|---|---|
| JP | 2006-162646 | A | 6/2006 |
| JP | 2007-163849 | A | 6/2007 |
| JP | 2011-180505 | A | 9/2011 |

*Primary Examiner* — Sevan A Aydin
(74) *Attorney, Agent, or Firm* — Canon USA, Inc., IP Division

(57) ABSTRACT

An electrophotographic roller includes an electro-conductive shaft core including a metallic layer at its surface, and an elastic layer on the shaft core. When kinetic friction coefficients of an outer peripheral surface of each end portion of the shaft core with respect to polyester resin are measured for one rotation of the shaft core, an average value μr of the kinetic friction coefficients is 0.05 to 0.50. When each outer peripheral surface is divided into three equal ranges, defined as a region A1, a region A2, and a region A3, in a peripheral direction of the shaft core, each of the regions has a location where the kinetic friction coefficients fall within a range of 1.5 μr to 1.8 μr, and a location where the kinetic friction coefficients fall within a range of 0.2 μr to 0.5 μr.

5 Claims, 2 Drawing Sheets

(56) References Cited

U.S. PATENT DOCUMENTS

| | | | | |
|---|---|---|---|---|
| 2014/0234764 | A1* | 8/2014 | Aoyama | G03G 15/0233 430/56 |
| 2015/0160588 | A1* | 6/2015 | Ito | G03G 15/1615 399/302 |

* cited by examiner

[Fig. 1]
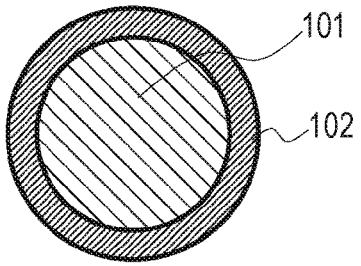
[Fig. 2]
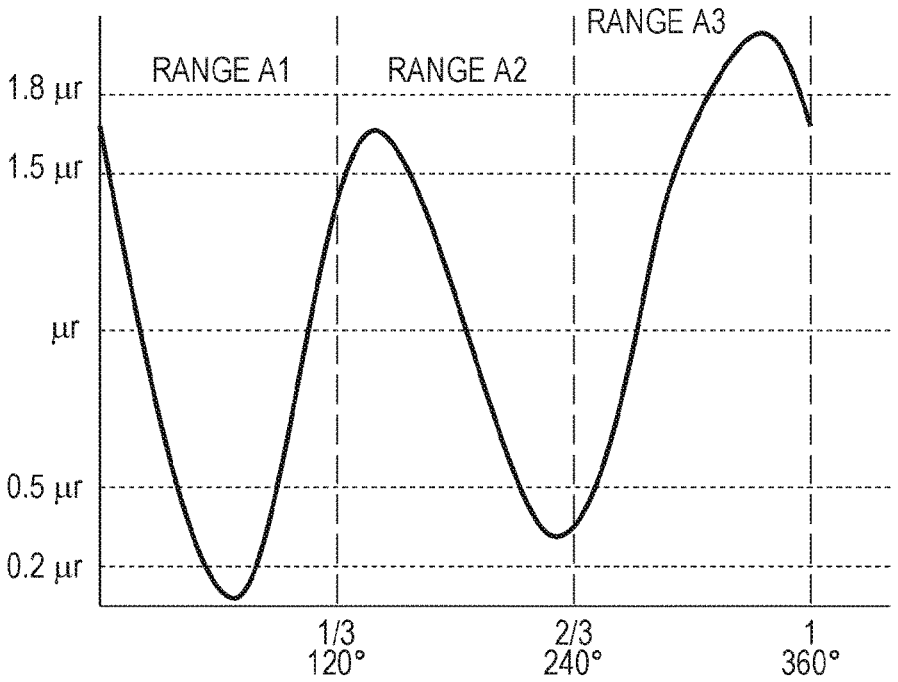

[Fig. 3]
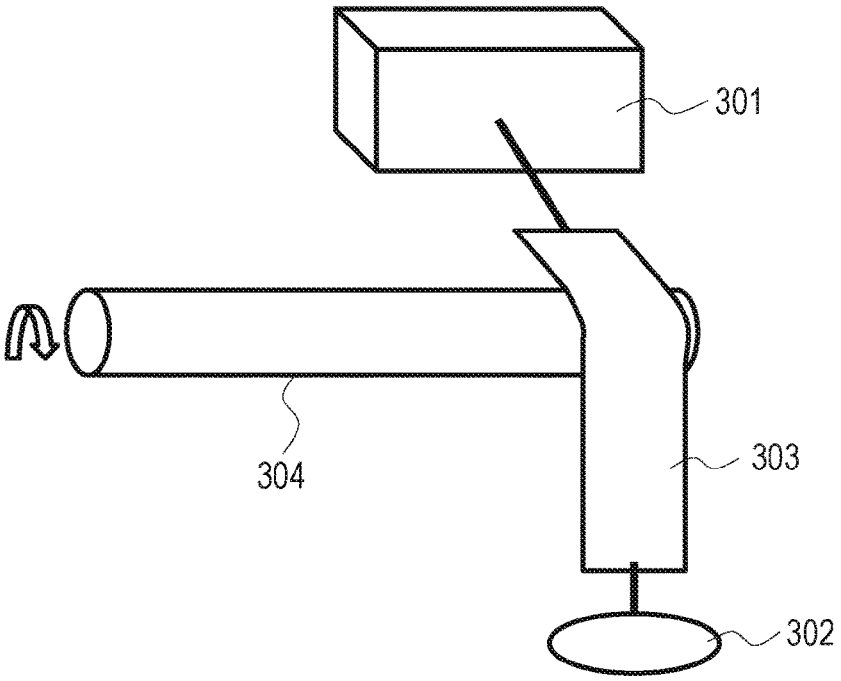
[Fig. 4]
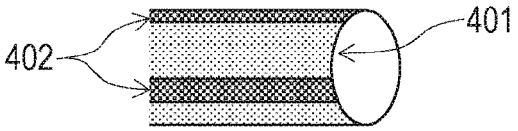

ELECTROPHOTOGRAPHIC ROLLER AND CHARGING APPARATUS

TECHNICAL FIELD

The present invention relates to an electrophotographic roller and a charging apparatus.

BACKGROUND ART

An electrophotographic image forming apparatus that includes a contact charging apparatus may use an electrophotographic photoconductor for forming an electrostatic image thereon and a charging roller that is disposed in contact with the electrophotographic photoconductor.

Here, PTL 1 discloses an image forming apparatus that includes an image carrier for forming an electrostatic image thereon, a charging member that is disposed so as to oppose the image carrier and that charges the image carrier, a pressing unit that applies a pressing force to the charging member towards the image carrier, and gap maintaining members that are mounted on two sides of the charging member, and that contact a surface of the image carrier and maintain a gap between the image carrier and the charging member. Friction force that is produced between the image carrier and each gap maintaining member causes the charging member to be driven and rotated with respect to the image carrier.

In paragraph number 0037, when the outside diameter of the spacer members is Φ12.0 mm, the radius of the cored bar is Φ46.0 mm, and the friction coefficient between the bearing and the cored bar is 0.13, if the axes of the charging roller and the electrophotographic photoconductor drum are horizontal and the rotational speed of the electrophotographic photoconductor drum is 200 rpm, the charging roller rotates if the friction coefficient is greater than 0.065.

CITATION LIST

Patent Literature

PTL 1: Japanese Patent Laid-Open No. 2006-162646

SUMMARY OF INVENTION

Technical Problem

The inventor et al. have studied the charging roller according to the invention in PTL 1, and have found that when the charging roller is used for a long time, abnormal noise may be produced.

Solution to Problem

One aspect of the present invention is directed to providing an electrophotographic roller that reduces the production of abnormal noise when an electrophotographic image forming apparatus operates.

Another aspect of the present invention is directed to providing a charging apparatus that reduces the production of abnormal noise caused by the rotation of a charging roller even if the charging apparatus is used for a long period of time.

According to one aspect of the present invention, there is provided an electrophotographic roller including an electro-conductive shaft core that includes a metallic layer at a surface thereof: and an elastic layer on the shaft core, wherein when kinetic friction coefficients of an outer peripheral surface of each end portion of the shaft core with respect to polyester resin are measured for one rotation of the shaft core, an average value pr of the kinetic friction coefficients is in a range of 0.05 to 0.50, and when the outer peripheral surface of each end portion is divided into three equal ranges, which are defined as a region A1, a region A2, and a region A3, in a peripheral direction of the shaft core, each of the regions has: a location where the kinetic friction coefficients fall within a range of 1.5 μr to 1.8 μr, and a location where the kinetic friction coefficients fall within a range of 0.2 μr to 0.5 μr.

According to another aspect of the present invention, there is provided a charging apparatus including an electrophotographic roller that charges an electrophotographic photoconductor, and a bearing that supports the electrophotographic roller, wherein the electrophotographic roller includes: an electro-conductive shaft core that includes a metallic layer at a surface thereof, and an elastic layer on the shaft core, wherein the bearing slidably supports an outer peripheral surface of each end portion of the shaft core of the electrophotographic roller, and wherein when kinetic friction coefficients between the outer peripheral surface of each end portion of the shaft core and the bearing are measured for one rotation of the shaft core, an average value r of the kinetic friction coefficients is in a range of 0.05 to 0.50, and when the outer peripheral surface of each end portion of the shaft core is divided into three equal ranges, which are defined as a region A1, a region A2, and a region A3, in a peripheral direction of the shaft core, each of the regions has a location where the kinetic friction coefficients fall within a range of 1.5 μr to 1.8 μr, and a location where the kinetic friction coefficients fall within a range of 0.2 μr to 0.5 μr.

Advantageous Effects of Invention

According to the one aspect of the present invention, it is possible to provide the electrophotographic roller that reduces the production of abnormal noise during the operation of the electrophotographic image forming apparatus.

According to the other aspect of the present invention, it is possible to provide the charging apparatus that reduces the production of abnormal noise caused by the charging roller.

BRIEF DESCRIPTION OF DRAWINGS

FIG. 1 is a schematic sectional view of an exemplary electrophotographic roller according to the present invention.

FIG. 2 illustrates an example of the results of measurements of kinetic friction coefficients.

FIG. 3 is a schematic view of a method of measuring kinetic friction coefficients.

FIG. 4 illustrates an example of polishing an outer peripheral surface of an end portion of an electro-conductive shaft core.

DESCRIPTION OF EMBODIMENTS

The present inventor et al. have found out that abnormal noise that is produced when the charging roller according to PTL 1 is used for a long period of time is caused by the state of contact between the end portions of the shaft core of the charging roller and the bearing that rotatably supports the end portions when the charging roller rotates. As a result of further study, the present inventor et al. have also found out that the production of abnormal noise caused by the state of contact can be reduced by prescribing the kinetic friction coefficients of the outer peripheral surface of each end portion of the shaft core slidably in contact with the bearing with respect to polyester resin.

That is, the present inventor et al. have found out that when the kinetic friction coefficients of the outer peripheral surface of each end portion of the shaft core with respect to polyester resin are measured for one rotation of the shaft core, an average value pr of the kinetic friction coefficients is in a range of 0.05 to 0.50; and that when the outer peripheral surface of each end portion is divided into three equal ranges, which are defined as a region A1, a region A2, and a region A3, in a peripheral direction of the shaft core, each of these regions includes locations where the kinetic friction coefficients fall within a range of 1.5 μr to 1.8 μr and locations where the kinetic friction coefficients fall within a range of 0.2 μr to 0.5 μr, so that it is possible to reduce abnormal noise caused by the state of contact.

A charging roller serving as an electrophotographic roller according to an embodiment of the present invention and a charging apparatus according to an embodiment of the present invention are described in detail below.

FIG. 1 is a schematic sectional view of an exemplary charging roller according to the present invention (a schematic sectional view when the charging roller is vertically cut with respect to an axial direction of an electro-conductive shaft core). The charging roller according to the present invention includes an electro-conductive shaft core 101 and an elastic layer 102 provided around an outer periphery of the shaft core 101. If necessary, an adhesive layer may be provided between the electro-conductive shaft core 101 and the elastic layer 102, and a surface layer may be provided on the elastic layer 102.

Conductive Shaft Core

The electro-conductive shaft core includes a metallic layer at its surface, and has conductivity. As long as the electro-conductive shaft core includes a metallic layer at its surface, it may have any shape. For example, the electro-conductive shaft core may be a columnar body having a solid structure or a cylindrical body having a hollow structure. In particular, since the rigidity of the hollow structure is less than that of the solid structure, vibration tends to occur, as a result of which abnormal noise tends to be produced. Therefore, the present invention is highly effective in reducing the production of abnormal noise. Since an electro-conductive shaft core formed into a cylindrical shape by pressing a flat plate, such as a metallic plate, has a joint in the flat plate, abnormal noise tends to be produced. Therefore, the present invention is highly more effective in reducing the production of abnormal noise. Further, even in the case of a structure in which the charging roller is pressed by being pushed in the direction of an electrophotographic photoconductor by, for example, a spring via the bearing, and is pushed against the electrophotographic photoconductor, the present invention is highly effective.

The electro-conductive shaft core may have a single layer structure or a multilayer structure. An example of the multilayer structure is a structure including a metallic layer formed at a surface of an insulating material. Examples of the metallic layer include an iron layer, a copper layer, a stainless steel layer, an aluminum layer, an aluminum alloy layer, and a nickel layer. Examples of the insulating material that is used in the multilayer structure include resin and ceramic.

"Outer peripheral surface of each end portion of the shaft core" means a portion on each of two end portions of the shaft core where the elastic layer is not formed at the surface of the shaft core, and where the shaft core contacts the bearing.

When the kinetic friction coefficients of the outer peripheral surface of each end portion of the shaft core with respect to polyester resin are measured for one rotation of the shaft core, an average value pr of the kinetic friction coefficients for one rotation in the peripheral direction is in the range of 0.05 to 0.50. When the average value μr of the kinetic friction coefficients for one rotation in the peripheral direction is in the range of 0.05 to 0.50, if the average value r is set so as to be less than or equal to 0.50, friction force between the outer peripheral surface of each end portion of the shaft core and the bearing is reduced, as a result of which a force that rotates the charging roller is reduced. In particular, when the charging roller in contact with the electrophotographic photoconductor is driven and rotated, the charging roller can be stably driven and rotated.

However, in order to reduce the average value pr of the kinetic friction coefficients to a small value, high-precision processing is required. This increases costs. In addition, when the charging roller is used for a long period of time, it is not easy to stably maintain the kinetic friction coefficients at small values. Further, even if the average value pr is less than or equal to 0.05, the effect in terms of stably rotating the charging roller is limited. Based on the results of study mentioned above, in the electrophotographic roller according to the embodiment of the present invention, the average value pr of the kinetic friction coefficient between the outer peripheral surface of each end portion of the shaft core and polyester resin is in the range of 0.05 to 0.50.

On the other hand, the present invention et al. have found out that it is possible to prevent the production of abnormal noise when there are variations in the kinetic friction coefficient of the shaft core in the peripheral direction. In the present invention, when the outer peripheral surface of each end portion of the shaft core is divided into three equal ranges, which are defined as a region A1, a region A2, and a region A3, in the peripheral direction of the shaft core, each of these regions needs to include locations where the kinetic friction coefficients fall within the range of 1.5 μr to 1.8 μr and location where the kinetic friction coefficients fall within the range of 0.2 μr to 0.5 μr.

FIG. 2 schematically illustrates an example of the results of measurements of the kinetic friction coefficients of each outer peripheral surface of the shaft core of an electrophotographic image forming apparatus according to an embodiment of the present invention with respect to polyester resin. The regions A1, A2, and A3, which are formed by dividing the outer peripheral surface of each end portion of the shaft core in three equal ranges in the peripheral direction, correspond to regions that measure 120°, which are formed by dividing the shaft core in three equal ranges in the peripheral direction. In each region, the kinetic friction coefficients need to differ. In FIG. 2, in the region A1, from 00 to approximately 100, the kinetic friction coefficients fall within the range of 1.5 μr to 1.8 μr, from approximately 40°, the kinetic friction coefficients fall within the range of 0.2 μr to 0.5 μr; further, after the kinetic friction coefficient becomes less than 0.2 μr, the kinetic friction coefficient increases; and from approximately 80° to approximately 90°, the kinetic friction coefficients fall within the range of 0.2 μr to 0.5 μr. Similarly, the regions A2 and A3 include locations where the kinetic friction coefficients fall within the range of 1.5 μr to 1.8 μr, and locations where the kinetic friction coefficients fall within the range of 0.2 μr to 0.5 μr. In the region A1, the minimum value is less than the values in the range of 0.2 μr to 0.5 μr, and, in the region A3, the maximum value is greater than the values in the range of 1.5 μr to 1.8 μr. However, all of these regions include locations where the kinetic friction coefficients fall within the range of 0.2 μr to 0.5 μr, and locations where the kinetic friction coefficients fall within the range of 1.5 μr to 1.8 μr. When the kinetic friction coefficients differ in the aforementioned way, it is possible to reduce the production of abnormal noise that is caused by the state of contact between the shaft core of the charging roller and the bearing and by long use of the charging roller.

The present inventor et al. believe that the production of abnormal noise by the charging apparatus can be reduced by using the electrophotographic roller according to the embodiment of the present invention due to the following reasons. When the kinetic friction coefficient is uniform, the shaft core and the bearing always maintain the same state of contact. The rotation of the charging roller causes the shaft core and the bearing to be scraped by friction. The scraping causes the contact area between the shaft core and the bearing to be increased, and the friction between the shaft core and the bearing to be increased. Therefore, vibration is produced, as a result of which abnormal noise is produced. In particular, when the bearing is made of resin, the bearing tends to be scraped by friction, as a result of which abnormal noise tends to be produced.

Examples of the resin that is used for the bearing include polyacetal, polyphenylene sulfide, polytetrafluoroethylene, and polyester.

The prescribing of the kinetic friction coefficients of the outer peripheral surface of each end portion of the shaft core of the charging roller according to the present invention is based upon the kinetic friction coefficient that is measured with reference to polyester resin. However, the electrophotographic roller including the shaft core in which the outer peripheral surface of each end portion has a roughness such that the kinetic friction coefficients that are measured with reference to polyester resin satisfy the prescriptions according to the present invention provides the advantages of the present invention regardless of the material of a sliding portion of the bearing with respect to the shaft core.

On the other hand, when the kinetic friction coefficients differ, the state of contact between the shaft core and the bearing changes. Therefore, although the shaft core and the bearing are scraped due to friction, it is possible to reduce an increase in the contact area. Consequently, it is possible to reduce the production of abnormal noise.

Examples of methods of varying the kinetic friction coefficient include surface treatment methods such as surface coating and surface processing of the outer peripheral surface of each end portion of the shaft core. Examples of the surface processing include a method of processing the surface by using a file and a method of processing the surface by using sandpaper.

Measurements of Kinetic Friction Coefficients

Kinetic friction coefficients are determined by measuring the kinetic friction coefficients between each end portion of the shaft core and a polyester resin film serving as a reference material.

FIG. 3 is an explanatory view of a method of measuring kinetic friction coefficients. A specific measurement method is as follows. First, a polyester film 303 (trademark: Lumirror S10 #100, manufactured by Toray Industries, Inc.) having one end connected to a load cell or a tension gauge 301 and having a certain load W302 applied to the other end is brought into contact with a surface of a shaft core 304 at a predetermined winding angle θ (90° in this embodiment). Then, a tension T of the polyester film when the polyester film is slid along the surface of the shaft core by rotating the shaft core at a certain speed in the direction of the arrow is detected.

Kinetic friction coefficient can be determined by applying the detected tension T, the load W, and the winding angle θ to the following Euler's equation.

$$\mu=(1/\theta)\times\ln(T/W)$$

Here, μ=kinetic friction coefficient, θ=winding angle (radians), W=load (g), and T=tension (g).

It is desirable that the load be 5 to 300 g for measurement, and the rotation speed be in a range of 10 to 300 rpm. It is desirable that the tension be sampled every 0.001 to 0.1 seconds.

Elastic Layer

The material of the elastic layer is not particularly limited to certain materials. Examples thereof may include rubber materials and resin materials. The rubber materials are not particularly limited to certain rubber materials. Rubbers that are publicly known in the field of electrophotographic conductive members may be used. Examples thereof include the following: epichlorohydrin homopolymer, epichlorohydrin-ethylene oxide copolymer, epichlorohydrin-ethylene oxide-allyl glycidyl ether ternary copolymer, acrylonitrile-butadiene copolymer, hydrogen-added acrylonitrile-butadiene copolymer, silicone rubber, acrylic rubber, and urethane rubber. The resin materials are also not particularly limited to certain resin materials. Resins that are publicly known in the field of electrophotographic conductive members may be used. Examples thereof include the following: acrylic resin, polyurethane, polyamide, polyester, polyolefin, epoxy resin, and silicone resin.

In order to adjust an electrical resistance value of the elastic layer, a conducting agent may be added to such rubber materials or resin materials, if necessary. Examples of the conducting agent are as follows: electronically conductive carbon black, graphite, oxides, such as tin oxides, metals, such as copper and silver, conductive particles to which conductive properties are imparted by coating particle surfaces with oxides and metals, and sulfonates and quaternary ammonium salts exhibiting ionic conduction. Within a range that does not adversely affect the advantages of the present invention, as rubber compounding agents or resin compounding agents, for example, generally used filling agents, softening agents, processing aids, tackifiers, anti-tack agents, dispersing agents, foaming agents, or coarse particles may be added. A reference of a volume resistivity of the elastic layer is in the range of $1\times10^3$ Ωcm to $1\times10^9$ Ωcm.

Charging Apparatus

The charging apparatus includes the electrophotographic roller (charging roller) according to the present invention that charges the electrophotographic photoconductor, and a bearing that supports the electrophotographic roller. The charging roller includes the electro-conductive shaft core having a metallic layer at its surface, and the elastic layer around the shaft core. The bearing slidably supports the outer peripheral surface of each end portion of the shaft core of the charging roller. It is desirable that a sliding surface of the bearing with respect to the outer peripheral surface of each end portion of the shaft core be made of a material containing polyester resin.

In the charging apparatus, when the kinetic friction coefficients between the outer peripheral surface of each end portion of the shaft core and the bearing are measured for one rotation of the shaft core, the average value r of the kinetic friction coefficients is in the range of 0.05 to 0.50; and when the outer peripheral surface of each end portion of the shaft core is divided into three equal ranges, which are defined as the region A1, the region A2, and the region A3, in the peripheral direction of the shaft core, each of these regions includes locations where the kinetic friction coefficients fall within the range of 1.5 μr to 1.8 μr and locations where the kinetic friction coefficients fall within the range of 0.2 μr to 0.5 μr.

EXAMPLES

The present invention is hereunder described in more detail by way of production examples and examples.

Production Example 1

1. Forming Conductive Shaft Core

As a material of the electro-conductive shaft core (hereunder referred to as "base material"), a solid columnar rod member (solid rod a) made of SUS304, having an overall length of 252 mm, and a diameter of 6 mm was provided. As shown in FIG. 4, peripheral surfaces of regions extending 10 mm from two end portions of the base material were polished by using sandpaper (LWCS-MS, #120 and #400, manufactured by Sankyo Rikagaku Co., Ltd.) to form a region 401. Next, at intervals of 120°, sandpaper #180 and sandpaper #80 were used to partly process the surface to form regions 402. By this, an electro-conductive shaft core 1 was formed.

2. Measuring Friction Force

At a temperature of 23.5° C. and a relative humidity of 60%, with the total load being 100 g, the winding angle being 90°, the rotation speed of a roller being 30 rpm, and the tension being sampled every 0.01 seconds, the kinetic friction coefficients of each end portion (end portion 1 and end portion 2) of the electro-conductive shaft core were measured by using the device shown in FIG. 3. By the above-described measurements, the average value r was calculated by averaging the kinetic friction coefficients determined on the basis of the sampled tensions for one rotation. The evaluation results are shown in Table 1.

Production Examples 2 to 11

As a base material, a hollow drawn material (hollow drawn rod b) made of stainless steel (SUS304), having an overall length of 252 mm, having an outside diameter of 6 mm, and having an inside diameter of 4.8 mm was prepared. As a base material, a flat plate made of SUS304 (t=0.6) was prepared, and was pressed and processed to a hollow columnar rod (hollow pressed rod c) having an overall length of 252 mm and a diameter of 6 mm.

By using the solid rod a, the hollow drawn rod b, or the hollow pressed rod c, with different polishing conditions being used as appropriate, the same operations as those in Production Example 1 were performed to form conductive shaft cores 2 to 11 in which peripheral surfaces of regions extending 10 mm from two end portions thereof were polished. In each of the production examples, sandpapers having different numbers and used for the processing were used as appropriate. In addition, the same operations as those in Production Example 1 were performed to measure the kinetic friction coefficients. The evaluation results are shown in Table 1.

TABLE 1

| | Conductive Shaft Core | End Portion 1 | | | | | | | End Portion 2 | | | | | | | Form of |
|---|---|---|---|---|---|---|---|---|---|---|---|---|---|---|---|---|
| | | Average | Maximum and Minimum Values of Kinetic Friction Coefficients in Three Equal Division Regions | | | | | | Average | Maximum and Minimum Values of Kinetic Friction Coefficients in Three Equal Division Regions | | | | | | Base |
| | | | A1 | | A2 | | A3 | | | A1 | | A2 | | A3 | | |
| | No. | Value μr | MAX | MIN | MAX | MIN | MAX | MIN | Value μr | MAX | MIN | MAX | MIN | MAX | MIN | Material |
| Production Example 1 | 1 | 0.12 | 1.63 | 0.43 | 1.57 | 0.40 | 1.60 | 0.37 | 0.13 | 1.65 | 0.48 | 1.58 | 0.39 | 1.59 | 0.36 | Solid Rod a |
| Production Example 2 | 2 | 0.06 | 1.67 | 0.48 | 1.70 | 0.47 | 1.72 | 0.33 | 0.07 | 1.67 | 0.47 | 1.72 | 0.45 | 1.70 | 0.33 | Solid Rod a |
| Production Example 3 | 3 | 0.48 | 1.52 | 0.21 | 1.56 | 0.25 | 1.67 | 0.35 | 0.46 | 1.56 | 0.23 | 1.51 | 0.27 | 1.63 | 0.38 | Solid Rod a |
| Production Example 4 | 4 | 0.13 | 1.51 | 0.39 | 1.52 | 0.38 | 1.51 | 0.33 | 0.12 | 1.52 | 0.41 | 1.53 | 0.40 | 1.52 | 0.41 | Hollow Pressed Rod c |
| Production Example 5 | 5 | 0.07 | 1.53 | 0.43 | 1.56 | 0.39 | 1.57 | 0.29 | 0.08 | 1.53 | 0.43 | 1.59 | 0.39 | 1.54 | 0.29 | Hollow Pressed Rod c |
| Production Example 6 | 6 | 0.47 | 1.55 | 0.21 | 1.60 | 0.26 | 1.70 | 0.36 | 0.48 | 1.53 | 0.22 | 1.57 | 0.28 | 1.72 | 0.38 | Hollow Pressed Rod c |
| Production Example 7 | 7 | 0.13 | 1.52 | 0.17 | 1.54 | 0.18 | 1.62 | 0.19 | 0.14 | 1.53 | 0.16 | 1.62 | 0.17 | 1.54 | 0.17 | Hollow Drawn Rod b |
| Production Example 8 | 8 | 0.12 | 2.00 | 0.43 | 2.05 | 0.41 | 2.07 | 0.36 | 0.13 | 2.08 | 0.41 | 2.07 | 0.40 | 2.05 | 0.38 | Hollow Drawn Rod b |
| Production Example 9 | 9 | 0.12 | 1.33 | 0.67 | 1.25 | 0.60 | 1.42 | 0.67 | 0.13 | 1.25 | 0.83 | 1.17 | 0.75 | 1.42 | 0.67 | Solid Rod a |
| Production Example 10 | 10 | 0.55 | 1.80 | 0.27 | 1.72 | 0.38 | 1.78 | 0.44 | 0.53 | 1.73 | 0.31 | 1.75 | 0.38 | 1.76 | 0.44 | Solid Rod a |
| Production Example 11 | 11 | 0.04 | 1.25 | 0.75 | 1.28 | 0.80 | 1.25 | 0.83 | 0.04 | 1.30 | 0.75 | 1.28 | 0.80 | 1.33 | 0.73 | Hollow Pressed Rod c |

Example 1

1. Producing Elastic Roller

Ingredients (1) in amounts shown in Table 2 were kneaded for 20 minutes in a kneader having a capacity of 6 L, and, then, Ingredients (2) in amounts shown in Table 2 were added. These were further kneaded for 8 minutes by an open roller to obtain an unvulcanized rubber composition. A thermosetting adhesive containing a metal and rubber (trademark: METALOC U-20, manufactured by Toyokagaku Kenkyusho Co., Ltd.) was applied to regions up to 115.5 mm from two sides with the center of a columnar surface of an electro-conductive shaft core 1 in an axial direction being disposed therebetween (and also regions having a width of 231 mm in the axial direction). After drying this at a temperature of 80° C. for 30 minutes, this was further dried at a temperature of 120° C. for one hour.

Next, by using a cross-head extruder, the unvulcanized rubber composition was extruded coaxially into a cylindrical shape having an outside diameter in a range of 8.75 to 8.90 mm onto the aforementioned conductive shaft core including an adhesive layer, and end portions were cut to place an unvulcanized conductive elastic layer (having a length of 242 mm) on the outer periphery of the shaft core. As the extruder, an extruder having a cylinder diameter of 70 mm and an L/D of 20 was used. Extrusion temperature conditions were head temperature=90° C., cylinder temperature=90° C., and screw temperature=90° C.

A roller obtained in this way was introduced into a continuous heating furnace having two zones set at different temperatures, and the unvulcanized rubber composition was vulcanized. With the first zone set at a temperature of 80° C., the rubber composition was passed through the first zone in 30 minutes, and, with the second zone set at a temperature of 160° C., the rubber composition was passed through the second zone in 30 minutes to vulcanize the unvulcanized rubber composition. As a result, the roller was formed into one including a vulcanized rubber layer.

Next, portions of the rubber layer at two ends of the rubber layer of the roller were cut to form the rubber layer into one having a width of 232 mm in the axial direction thereof. Thereafter, by grinding the surface of the rubber layer with a rotary grinding wheel, the roller was formed into an elastic roller including a crown-shaped elastic layer having an end-portion diameter of 8.26 mm and a central-portion diameter of 8.5 mm was obtained.

TABLE 2

| | Material | Parts by Mass |
|---|---|---|
| Ingredients (1) | NBR (Trademark: Nipol DN219, manufactured by Zeon Corporation) | 100 |
| | Zinc Oxide | 5 |
| | Zinc Stearate | 1 |
| | Calcium Carbonate (Trademark: Silver-W, manufactured by Shiraishi Calcium Kaisha, Ltd.) | 20 |
| | Carbon Black (Trademark: SEAST 300, manufactured by Tokai Carbon Co., Ltd.) | 46 |
| Ingredients (2) | N-tert-butyl-2-benzothiazolesulfenamide (Trademark: Nocceler NS, manufactured by Ouchi Shinko Chemical Industrial Co., Ltd.) | 2 |
| | Sulfur | 1.2 |

2. Producing Charging Roller

Next, ultraviolet light having a wavelength of 254 nm was applied to the elastic layer of the elastic roller with an integrated amount of light of 9000 mJ/cm$^2$. In applying the ultraviolet light, a low pressure mercury lamp was used. By performing the above, a charging roller 1 was obtained.

3. Evaluating Following Property with Respect to Photoconductor

The peripheral speed of an electrophotographic photoconductor and the peripheral speed of the charging roller when the charging roller was driven and rotated with respect to the electrophotographic photoconductor were measured. The peripheral speeds were calculated by measuring and calculating the time required for the charging roller and the electrophotographic photoconductor to rotate ten times by using a stopwatch. The measurements were carried out three times. By using the average value thereof, the ratios of the peripheral speed of the charging roller with respect to the peripheral speed of the electrophotographic photoconductor are indicated.

Peripheral Speed Ratio=(Peripheral Speed of Charging Roller)/(Peripheral Speed of Photoconductor)×100(%)

In the test, if the peripheral speed ratio is greater than or equal to 95%, no problems occur in terms of images, so that no problems occur in terms of actual use.

4. Durability Test

An electrophotographic laser printer (trademark: LBP 5400, manufactured by Canon Inc.) was modified, and the output speed of recording media was 200 mm/sec and the image resolution was 600 dpi. The material of a bearing of the charging roller of LBP 5400 was polyacetal resin.

The charging roller 1 was installed in the modified electrophotographic image forming apparatus, and image evaluations were performed. After the rotation of the electrophotographic image forming apparatus was stopped when an image for one sheet had been output, an operation of restarting an image forming operation was repeated (1% print image of character E corresponding to intermittent durability) to perform image output durability tests for 20,000 sheets. Here, the evaluations were performed on the basis of the number of sheets that had been used when abnormal noise was generated. The sheets were counted in units of 500 sheets, and the numbers of sheets are shown such that when the units of 500 sheets was not reached in counting the sheets, such sheets were excluded from the count. In the test, in the case that the number of sheets that are used when abnormal noise is produced was greater than or equal to 10,000 sheets, the charging roller 1 was evaluated as a charging roller having enough durability with respect to the supposed length of life. In addition, abnormal noise derived from the shaft core and the bearing in the test is noise that is produced during charging of the electrophotographic photoconductor. Other noises derived from other sources, such as motor noise, are different in the timing in which they are produced and in sound quality. Therefore, such noises were easily distinguished from the abnormal noise. The evaluation results are shown in Table 3.

Example 2 to Example 8, Comparative Examples 1 to 3

Other than using conductive shaft cores shown in Table 3 that differ from the electroconductive shaft core 1, as in Example 1, charging rollers 2 to 11 were prepared and following property evaluations with respect to the electrophotographic photoconductor and durability tests were performed. The evaluation results are shown in Table 3.

TABLE 3

| | | Following Property Evaluation with respect to Photoconductor Peripheral-Speed Ratio | Durability Test Number of Sheets Used When Abnormal Noise Was Produced |
|---|---|---|---|
| Example 1 | Conductive Shaft Core 1 | 99.4% | No Abnormal Noise Produced Even When 20,000 Sheets Were Used |
| Example 2 | Conductive Shaft Core 2 | 99.9% | 19,000 |
| Example 3 | Conductive Shaft Core 3 | 96.2% | 19,500 |
| Example 4 | Conductive Shaft Core 4 | 99.4% | 17,000 |
| Example 5 | Conductive Shaft Core 5 | 99.9% | 16,500 |
| Example 6 | Conductive Shaft Core 6 | 95.9% | 17,500 |
| Example 7 | Conductive Shaft Core 7 | 99.4% | 18,000 |
| Example 8 | Conductive Shaft Core 8 | 99.1% | 18,000 |
| Comparative Example 1 | Conductive Shaft Core 9 | 99.6% | 8,000 |
| Comparative Example 2 | Conductive Shaft Core 10 | Rotation of Charging Roller Stopped | Evaluation not Carried Out |
| Comparative Example 3 | Conductive Shaft Core 11 | 99.8% | 7000 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-132036, filed Jun. 30, 2015, which is hereby incorporated by reference herein in its entirety.

The invention claimed is:

1. An electrophotographic roller comprising:

an electro-conductive shaft core that includes a metallic layer at a surface thereof; and an elastic layer on the shaft core, wherein, when kinetic friction coefficients of an outer peripheral surface of each end portion of the shaft core with respect to polyester resin are measured for one rotation of the shaft core, an average value μr of the kinetic friction coefficients is in a range of 0.05 to 0.50, and when the outer peripheral surface of each end portion is divided into three equal ranges, which are defined as a region A1, a region A2, and a region A3, in a peripheral direction of the shaft core, each of the regions has:

a location where the kinetic friction coefficients fall within a range of 1.5 μr to 1.8 μr, and a location where the kinetic friction coefficients fall within a range of 0.2 μr to 0.5 μr.

2. The electrophotographic roller according to claim 1, wherein the shaft core has a hollow structure.

3. The electrophotographic roller according to claim 1, wherein the shaft core is formed into a cylindrical shape by pressing a metallic plate.

4. A charging apparatus comprising:

an electrophotographic roller that charges an electrophotographic photoconductor; and a bearing that supports the electrophotographic roller, wherein, the electrophotographic roller includes:

an electro-conductive shaft core that includes a metallic layer at a surface thereof, and an elastic layer on the shaft core, the bearing slidably supports an outer peripheral surface of each end portion of the shaft core of the electrophotographic roller, and when kinetic friction coefficients between the outer peripheral surface of each end portion of the shaft core and the bearing are measured for one rotation of the shaft core, an average value μr of the kinetic friction coefficients is in a range of 0.05 to 0.50, and when the outer peripheral surface of each end portion of the shaft core is divided into three equal ranges, which are defined as a region A1, a region A2, and a region A3, in a peripheral direction of the shaft core, each of the regions has:

a location where the kinetic friction coefficients fall within a range of 1.5 μr to 1.8 μr, and a location where the kinetic friction coefficients fall within a range of 0.2 μr to 0.5 μr.

5. The charging apparatus according to claim 4, wherein a sliding surface of the bearing with respect to the outer peripheral surface of each end portion of the shaft core is made of a material containing polyester resin.

* * * * *